US006059430A

United States Patent [19]

Chen

[11] Patent Number: 6,059,430

[45] Date of Patent: May 9, 2000

[54] DECORATIVE LAMP ASSEMBLY

[76] Inventor: Jui-Chang Chen, No. 100, Ten Mei 3rd Street, Hsinchu, Taiwan

[21] Appl. No.: 09/041,996

[22] Filed: Mar. 13, 1998

[51] Int. Cl.[7] ..... F21V 11/00

[52] U.S. Cl. ..... 362/353; 362/363; 362/806

[58] Field of Search ..... 362/246, 249, 362/237, 353, 363, 437, 438, 806

[56] References Cited

U.S. PATENT DOCUMENTS 5,749,648 5/1998 Lin ..... 362/353

5,911,501 6/1999 Katz ..... 362/353 X

*Primary Examiner*—Stephen Husar

*Attorney, Agent, or Firm*—Rosenberg, Klein & Lee

[57] ABSTRACT

This invention relates to a connector of a lamp holder and a lamp shield, wherein the connector is cylindrical and made of plastic for receiving the lamp holder with a bulb and is provided with a flange to engage with the lamp shield. The lamp shields are possibly transparent and have various configurations for decorating. Each connector engaged with a lamp holder of a light bulb string and a various lamp shield. When the light bulb string is put around a Christmas tree, the lamp shields being special decorations are already hung on the tree at the same time.

5 Claims, 7 Drawing Sheets

DECORATIVE LAMP ASSEMBLY

BACKGROUND OF THE INVENTION

During Christmas time, people always place a Christmas tree in the house and put a light bulb string with a lot of various decorations on the tree for celebration. It is known that the decorations must be connected with the branches of the tree one by one. It needs much time and it is somehow trouble for doing so.

OBJECT OF THE INVENTION

The main object of the present invention is to provide a connector, which is provided for easily connecting with the lamp holders and the lamp shields being various decorations. This light bulb string is capable of being put around the tree and the lamp shields are hung already on the tree for decorating at the same time.

The detailed structure, features, and other advantages of this invention will become apparent from the following detailed description of a preferred embodiment when read with reference to the accompanying drawings.

DETAILED DESCRIPTION OF THE EMBODIMENT

Figure 1:
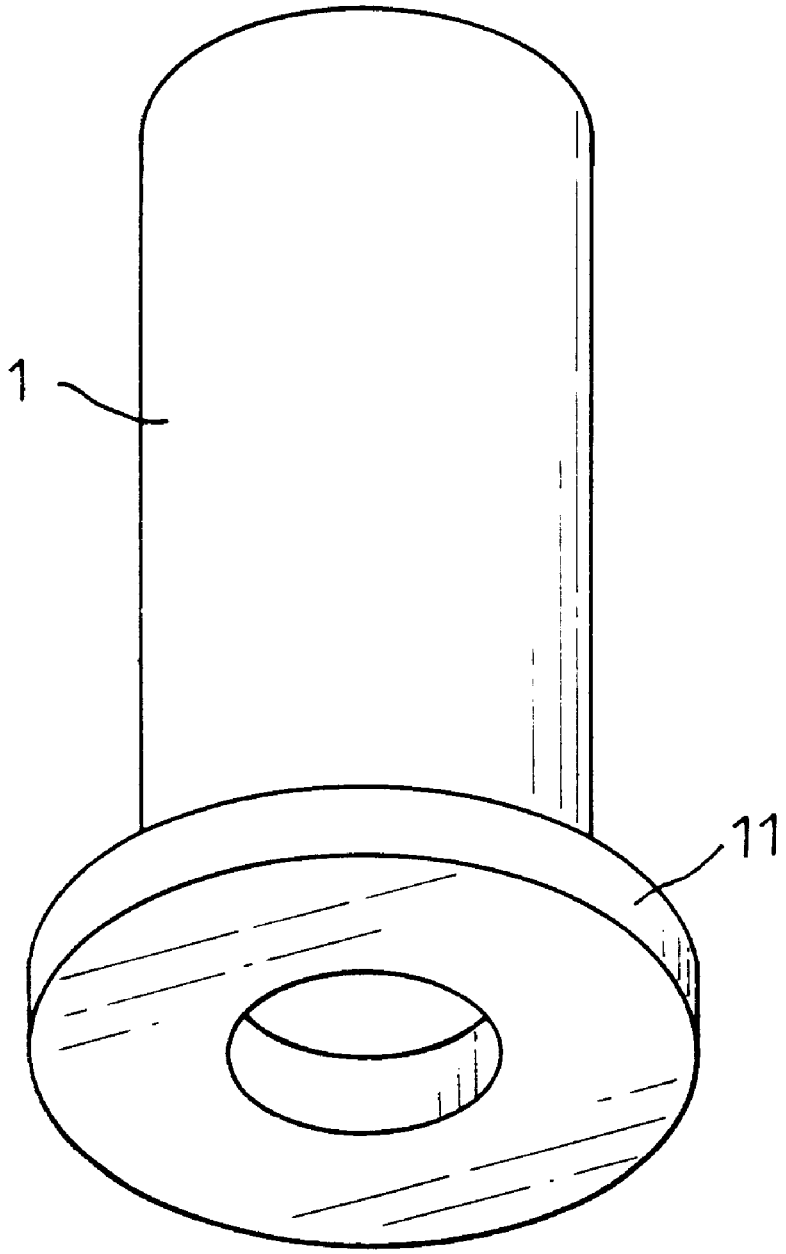
FIG. 1 is a perspective view showing a connector according to the present invention.
Figure 2:
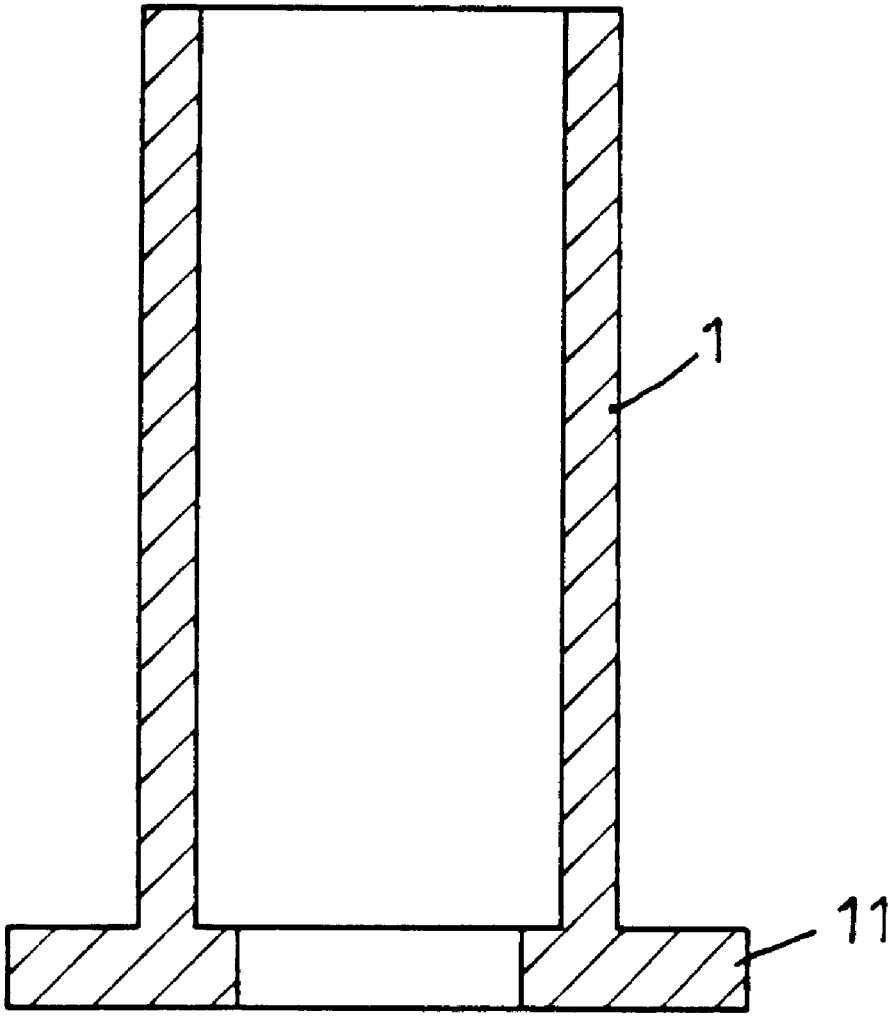
FIG. 2 is a cross sectional view of FIG. 1 of the present invention.
Figure 3:
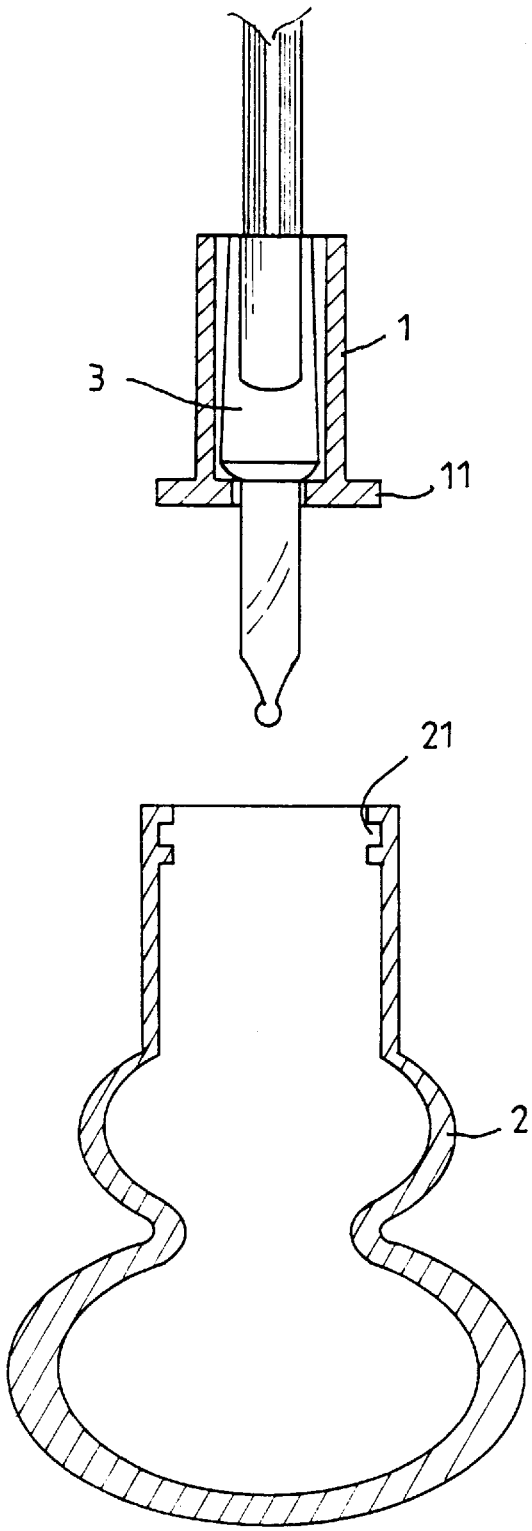
FIG. 3 is an exploded cross sectional view showing an exemplar of the present invention.
Figure 4:
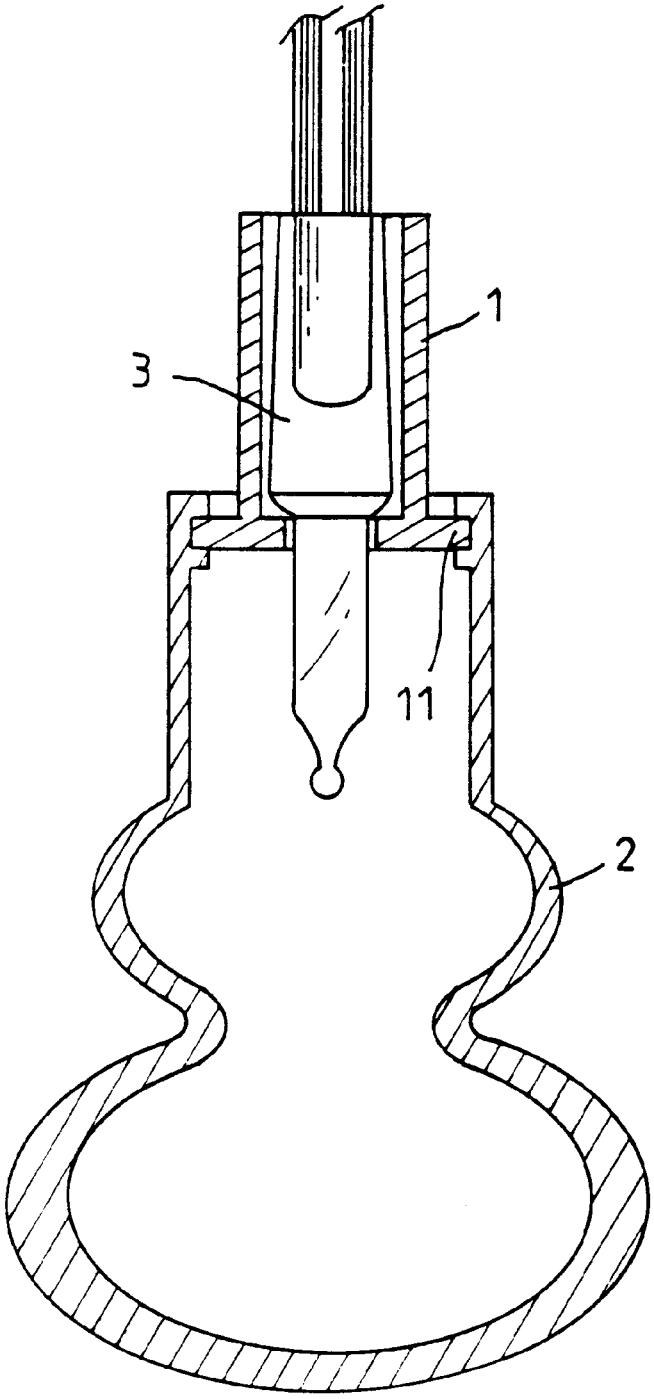
FIG. 4 is an assembled view of FIG. 3 of the present invention.

Referring to FIGS. 1 to 4, the present invention includes a connector (1) and a lamp shield (2) being possibly transparent. The connector (1) is cylindrical and has a flange (11) at the end. It is made of plastic for receiving a lamp holder (3) with a bulb (31) therein. The lamp shield (2) is capable of being designed with various shapes to be the decorations. It has an opening having an engaged groove (21) inside. The flange (11) of the connector (1) is capable of being engaged with the groove (21) of the lamp shield (2) while the bulb (31) is placed in the inner space of the shield (2). Each lamp holder (3) of a light bulb string is provided with a connector (1) and a various lamp shield (2). When the light bulb string is put around a Christmas tree, various decorations of the lamp shields (2) are already hung on the tree at proper positions at the same time. It is very convenient and overcomes the drawback of the prior one. Meanwhile, the light of the bulb (31) is possible of being transparent from the lamp shield (2), which provides a different special decorating effect other than the known one.

Figure 5:
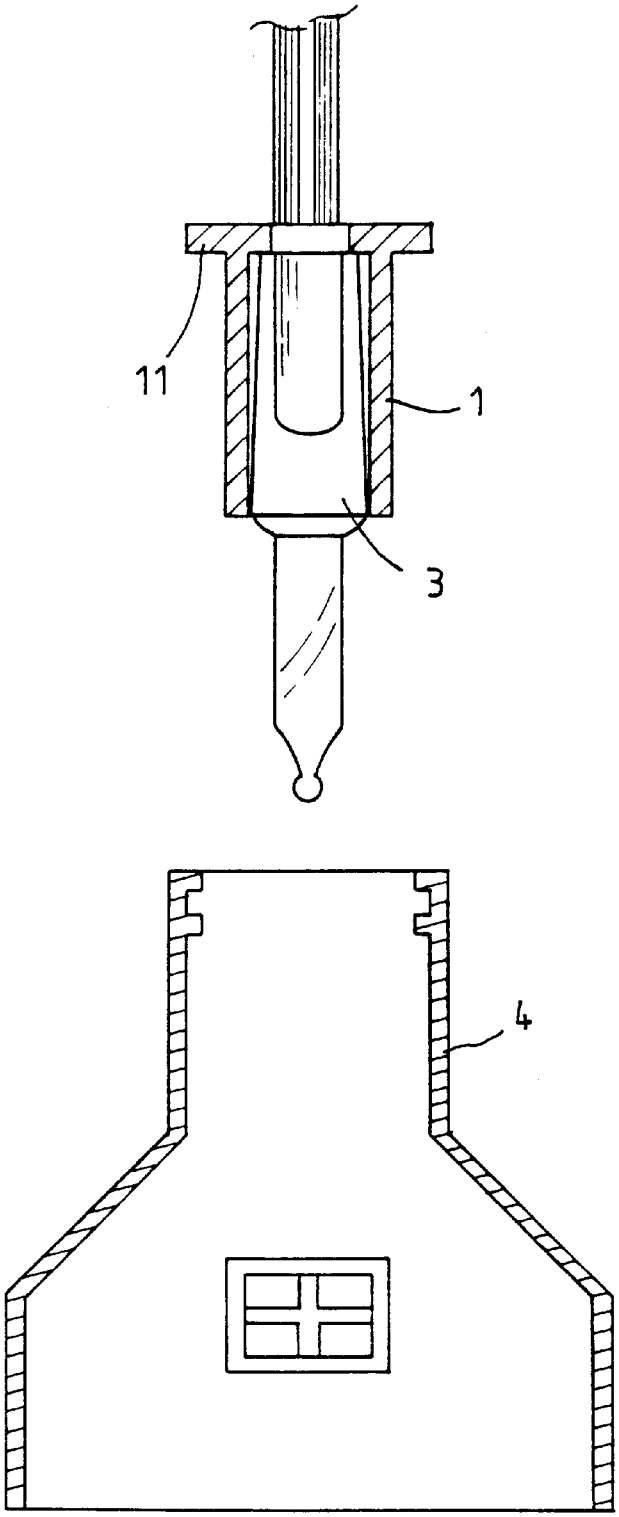
FIG. 5 is an exploded cross sectional view showing another exemplar of the present invention.
Figure 6:
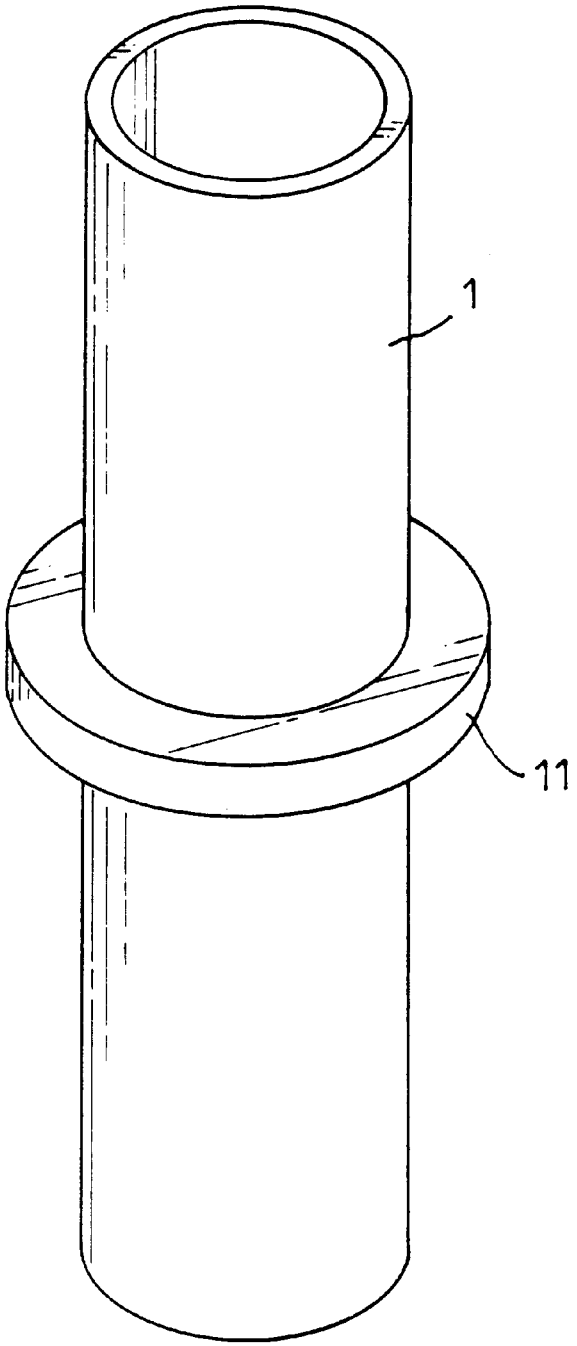
FIG. 6 is a perspective view of another exemplar of a connector according to the present invention.
Figure 7:
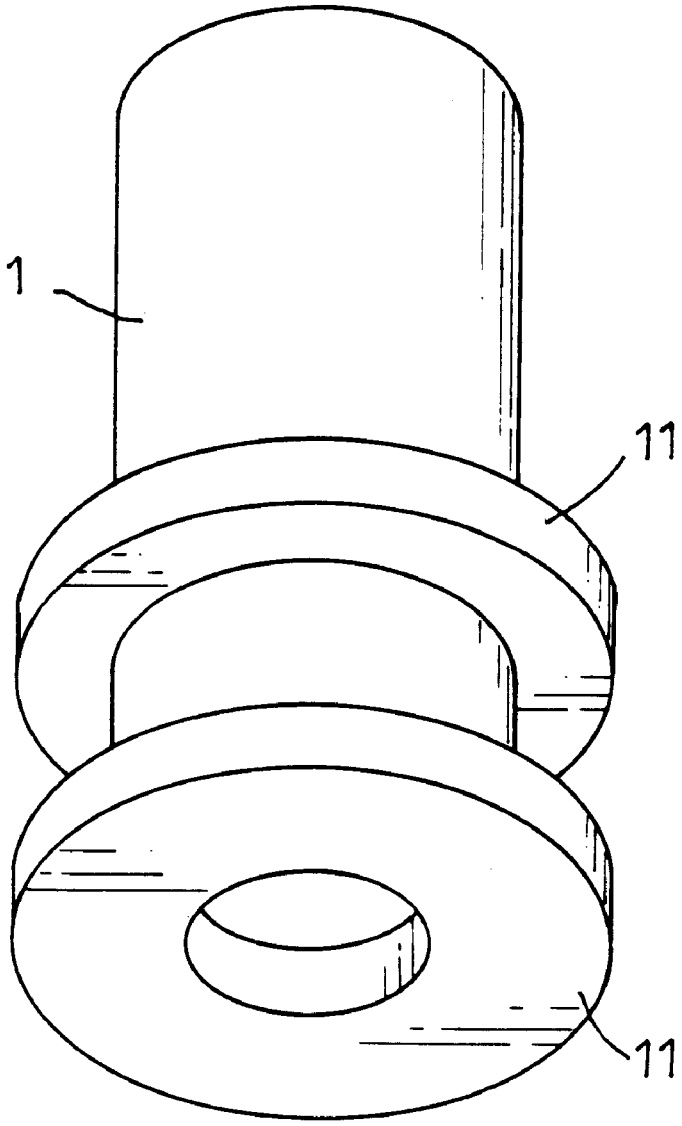
FIG. 7 is a perspective view of a further exemplar of a connector according to the present invention.

As shown in FIG. 5, the connector (1) of the invention is capable of being engaged with the lamp holder (3) and the bulb (31) in an opposite direction to connect with another lamp shield (4) with a various configuration. Moreover, the flange (11) of the connector (1) is capable of being provided at a different position as shown in FIG. 6. It is also possible to provide with two flanges on the connector (2), as in FIG. 7 that can be engaged with a related lamp shield with two grooves therein for firmly connecting between the holder and the shield.

In conclusion, the present invention provides an obvious advantage for connecting the lamp holders with the lamp shields with various configurations, that provides an improvement for easily decorating a Christmas tree with a light bulb string. Thus, the present invention should be allowed for patent.

I claim:

1. A decorative lamp assembly comprising:

(a) a lamp shield having an engagement portion and a decorative portion extending therefrom, said decorative portion having a predetermined contour defining an inner space, said engagement portion having formed therein an opening in communication with said inner space and at least one engagement groove internally disposed adjacent said opening;

(b) a connector coupled to said lamp shield, said connector having a longitudinally extended base portion and at least one flange portion projecting therefrom, said base portion having formed therein an inner chamber, said flange portion received in said engagement portion of said lamp shield through said opening and lockingly engaging said engagement groove substantially in snap fit manner; and, (c) a lamp holder received within said inner chamber of said connector;

whereby a lamp retained by said lamp holder is disposed within said inner space of said lamp shield.

2. The decorative lamp assembly as recited in claim 1 wherein said base portion of said connector includes longitudinally opposed first and second end section and an intermediate section extending therebetween, said flange portion projecting from at least one of said sections.

3. The decorative lamp assembly as recited in claim 1 wherein said connector includes a plurality of said longitudinally spaced flange portions, and said lamp shield includes a plurality of said engagement grooves for respective engagement therewith.

4. The decorative lamp assembly as recited in claim 1 wherein said decorative portion of said lamp shield is substantially bulbous in contour.

5. The decorative lamp assembly as recited in claim 1 wherein said decorative portion of said lamp shield is substantially polygonal in contour.

* * * * *